United States Patent [19]

Burger

[11] Patent Number: 4,901,914

[45] Date of Patent: Feb. 20, 1990

[54] MAIL BOX SIGNAL

[76] Inventor: Robert J. Burger, 4240 Ontario Center Rd., Walworth, N.Y. 14568

[21] Appl. No.: 263,061

[22] Filed: Oct. 27, 1988

[51] Int. Cl.[4] ..... B65D 91/00

[52] U.S. Cl. ..... 232/35; 232/34

[58] Field of Search ..... 232/34, 35, 17

[56] References Cited

U.S. PATENT DOCUMENTS

| | | | |
|---|---|---|---|
| 1,123,647 | 1/1915 | Ackman | 232/34 |
| 2,078,160 | 4/1937 | Reed | 232/35 |
| 2,421,603 | 6/1947 | Doppelhammer | 232/35 |
| 2,988,268 | 6/1961 | Mioduski | 232/35 |
| 3,301,475 | 1/1967 | Clark | 232/35 |
| 4,063,681 | 12/1977 | Tong | 232/34 |

*Primary Examiner*—Robert W. Gibson, Jr.
*Attorney, Agent, or Firm*—Robert M. Phipps

[57] ABSTRACT

A mail box or similar container having a self cancelling signal indicator which is activated by the opening of the mail box door. The signal is a crankshaft which has on each end of the crankshaft a crank arm, each arm being perpendicular to said crankshaft and in an offset direction to the other crank arm, one of said crank arms having at the end opposite said crankshaft a combination weight and position indicator.

8 Claims, 2 Drawing Sheets

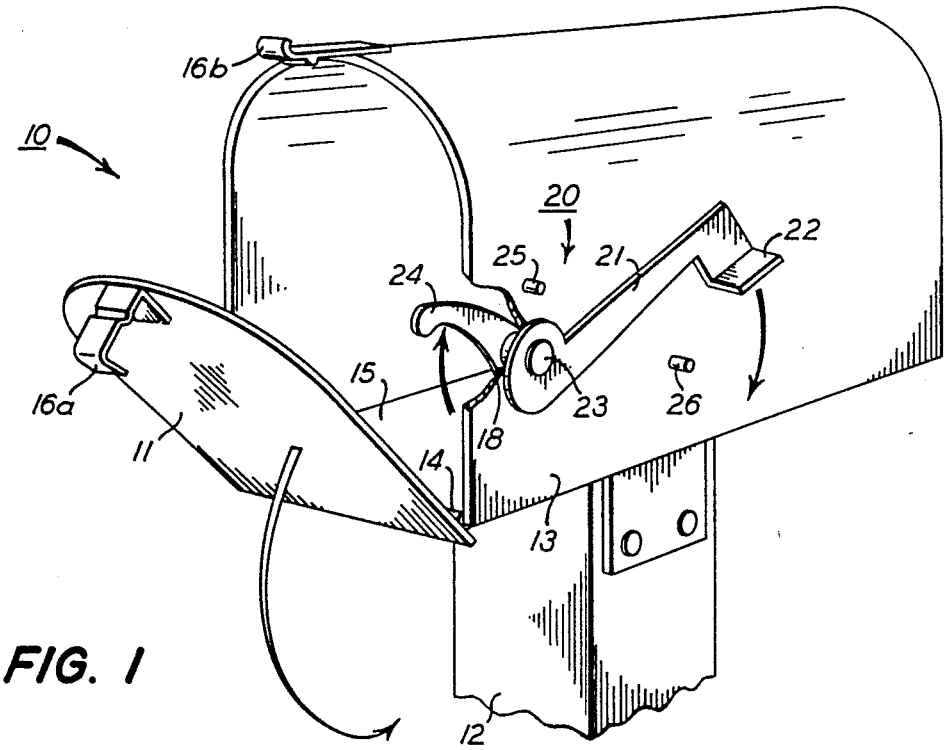
FIG. 1
FIG. 2
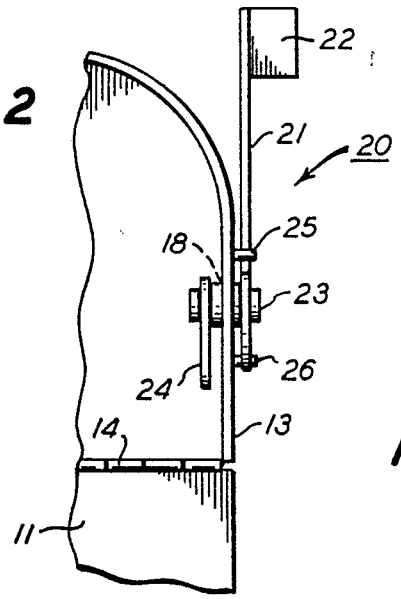
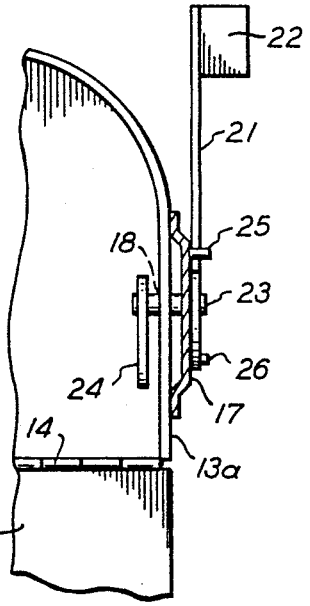
FIG. 3

MAIL BOX SIGNAL

BACKGROUND

1. Field of the Invention

This invention relates to improved means of operating the signal on mail boxes and similar containers.

2. Description of the Prior Art

Boxes approved by the Postmaster General for holding the patron's mail on rural and mounted mail routes are equipped with a signal or flag device. The signal is raised when there is mail to be collected by the letter carrier. When the mail is removed the carrier must, as a separate action, then lower the signal to the empty or no mail to be collected position. Sometimes the signal is not fully returned to the no mail pickup position because of difficulty by the carrier in grasping the signal. In either event the collection of mail could be made more efficient by the elimination of the signal movement operation by the carrier. The signal is held in the raised position by friction and after the signal mechanism has rusted or become encrusted with ice the operation of it in any direction becomes difficult. Additionally, the signal latch often wears and loosens to the point where strong blasts of air, either from passing vehicles or natural causes, the signal to move, or fall, to the no mail position, thus misleading the mail carrier into not stopping at that box.

It is an object of this invention to provide mail boxes and the like with a self cancelling signal. Another object is to provide a more easily moved signal. Still another object is to provide a signal which is not operable by air currents. Still other objects will be apparent to those skilled in the arts upon reference to the following detailed description.

SUMMARY OF THE INVENTION

In accordance with this invention there is provided in a mail box or similar container which is open at one end, said box having a door hinged along one edge of said open end for closing said opening, the improvement comprising a self cancelling signal positioned on a side wall of said mail box near said open end, said signal having a crank shaft extending through an opening in said side wall to the exterior of and to the interior of said mail box and to each end of the crank shaft is a crank arm, each arm being perpendicular to said crank shaft and in an offset direction to the other crank arm, said crank arm on the interior of said box extending from said crankshaft through the plane of said door when in the closed position, said arm on the exterior of said box having at it's end opposite said crankshaft a combination weight and position indicator.

BRIEF DESCRIPTION OF THE DRAWINGS

FIG. 1 is a side perspective view of a mail box, with open door, equipped with signal device of this invention;

FIG. 2 is a view into the mail box of FIG. 1 with the signal assembly in the "raised position";

FIG. 3 is similar to FIG. 2 and shows the mail box of FIG. 1 equipped with an alternate metal plate support (in cross section);

DESCRIPTION OF THE PREFERRED EMBODIMENTS

Figure 4:
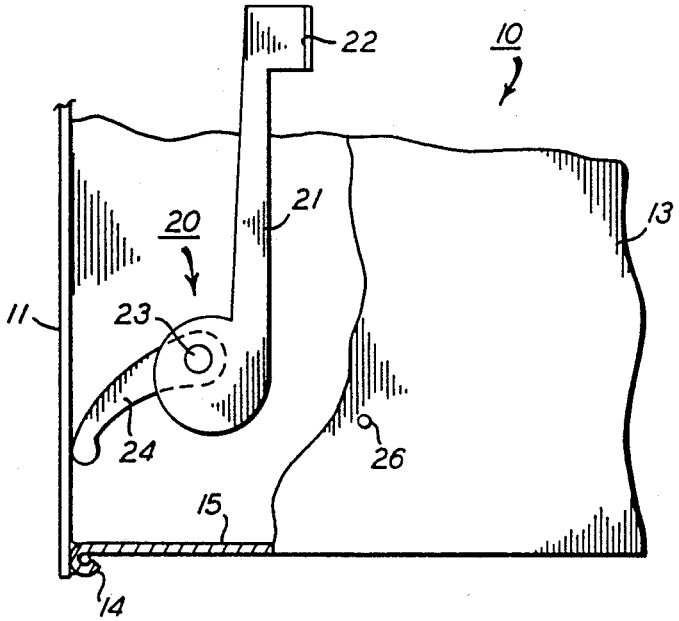
FIG. 4 is a break away view of the mail box of FIG. 1 with the door closed.

The approved mail box for receipt and dispatch of mail on a mounted or motorized route typically consists of an elongated hollow container with one end permanently closed off. The other end is closed off by a door mounted on a hinge. On the exterior, at one side of the box, is mounted a signal, often referred to an a flag, which can be raised or lowered around a fixed point. The exact configuration of the mail box can and has varied and the roof, or top, may be flat, peaked or domed.

The mail box 10 as shown in FIG. 1 has a domed roof section which gives away to side walls 13 that end at and are attached to the mail box floor or bottom 15. The mail box 10 is attached at the floor 15 by conventional means to the mail box mounting support 12. The open end of the box 10 is closed by a door 11 which is attached to and rotates from a hinge 14 that is affixed to the floor 15 of the box 10. On the side wall 13 and towards the door 11 is mounted a signal assembly 20 comprised of a crankshaft 23, crank arms 21, 24 and position indicator 22. Through an opening 18 on the exterior of wall 13 crankshaft 23 extends through the side wall 13. Attached to the exterior end of the crankshaft 23 is one end of the exterior crank arm 21 while to the other end of the crank arm 21 is attached the position indicator and counterweight 22. Inside the mail box 10 and extending through the plane of the door 11 when closed is the second, the interior, crank arm 24 of the signal assembly 20. From the doorway to the crankshaft 23 the interior crank arm 24 is shown by broken lines. When in the closed position the door 11 is held in place by latch 16 which is composed of two latch members 16*a*, 16*b*. If due to the location of the crankshaft 23 and the length of interior crank arm 24 the floor 15 does not limit the travel of the crank arm 24 then a stop pin 25 is provided on the exterior of the side wall 13 above crank shaft 23. Stop pin 25 then limits the forward travel of exterior crank arm 21 towards the door 11.

Optionally a stop or rest 26 as shown in FIG. 1 may be attached to the side wall 13 at or near the floor 15 to hold the position indicator 22 at a predetermined point when in the no mail or rest position. The stop 26 may be a pin, ledge or of other desired configuration. Without such a stop 26 and depending on the length of interior crank arm 24, location of the crank shaft 23 and the configuration of side wall 13 the position indicator 22 might come to rest at a point below the floor 15 making activation of the signal assembly 20 less convenient.

FIG. 2 is a view into the mail box of FIG. 1 and illustrates the open end of the mail box 10, and on both sides of side wall 13 can be seen the signal assembly 20 in the "raised position". In this view the free end of interior crank arm 24 comes forward through the plane of the door 11 when closed. The crankshaft 23 is seen extending through the opening 18 of side wall 13 and terminating in the exterior crank arm 21 which connects to position indictor 22.

FIG. 3 is similar to FIG.2 and shows the mail box 10 of FIG. 1 equipped with an alternate metal plate support 17, the support being shown in cross section. In this view the opening 18 of side wall 13*a* supports crank shaft 23. Attached to the exterior end of crankshaft 23 is crank arm 21 while attached to the interior end of crankshaft 23 is crank arm 24. When the side wall 13 is made of wood boards of typical construction thickness or very heavy plastic the side wall 13 is sufficiently thick to hold the crankshaft 23 in position without further support. However, when the side wall 13*a* is thin, as a sheet of metal as shown in this figure, thin gauge plastic or the like, then additional support is desirable. The additional support can be in the form of bushings anchored to the side wall 13, bowed sheet metal plate surrounding the crankshaft opening and combinations thereof. However, the use of a metal plate 17 attached to thin side wall 13*a* for added support as shown is preferred. The metal plate 17 may be attached by welding, bolting, rivets or the like as is convenient. Optionally a bushing may extend through the opening 18 of both the side wall 13*a* and the plate 17.

The door 11 is typically attached via a hinge 14 to the mail box floor 15 as shown in FIG. 1. However, it is within the scope of this invention to have the hinge 14 attached to the vertical or straight section of either side wall 13.

It is within the scope of this invention to provide an interior crank arm 24 which is straight rather than curved as shown in FIG. 1. But, for reasons of convenience and safety it is preferable for the crank arm 24 to have a slight downward bend toward the floor 15 and to terminate in a rounded manner, e.g. a looped or balled end.

When the door 11 is closed as shown in FIG. 4 the interior crank arm 24 rests against the door 11 and is near, but not necessarily at, the box floor 15. At the same time the exterior crank arm 21 is in a vertical position and the position indicator 22 at the top of the mail box 10. When the signal assembly 20 is so activated the interior crank arm 24 normally is limited in its path of travel to a space between the door 11 and the floor 15.

Figure 5:
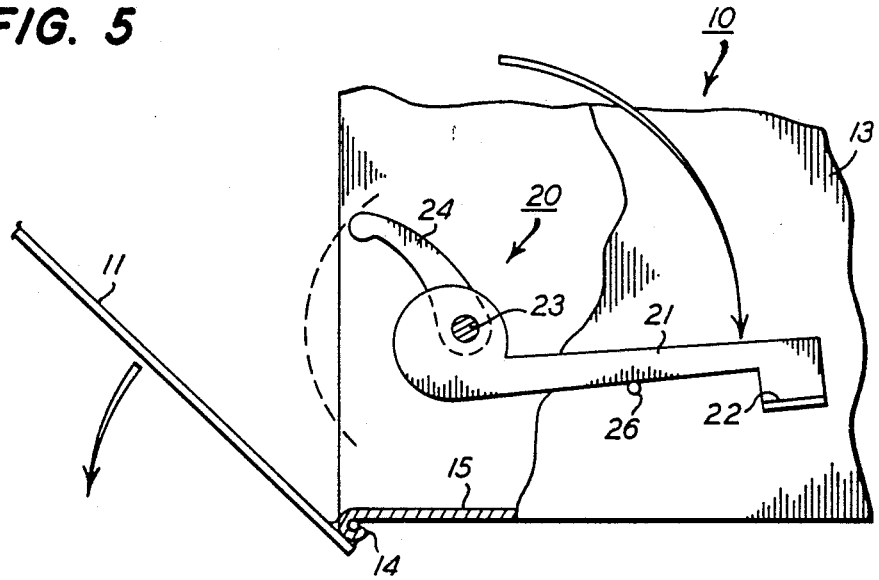
FIG. 5 is a break away view of the mail box of FIG. 1 showing the operation of the signal device as the door is opened.

The signal assembly 20 is activated by raising the exterior crank arm 25 to its substantially vertical position and while holding arm 24 in position closing the door 11. When closed, the door 11 holds arm 24 in position as shown in FIG. 4. When the door 11 is opened as shown in FIG. 5, arm 24 rotates upwardly and position indicator 22 rotates downwardly because of the weight of exterior signal arm 21 and position indicator 22 to automatically return to the no mail, "lowered" or rest position. The return to the no mail position may be accelerated by the off center attachment of exterior crank arm 21 to the crank shaft 23.

The manufacture and assembly of the crankshaft 23 and crank arms 21, 14 employs well known techniques and is a matter of choice and convenience. The crank arms 21, 24 may be attached to crankshaft 24 for instance by welding or friction fit. The opening 18 in side wall 13 may be circular or oblong as desired to facilitate insertion of the crankshaft 14 into and through the side wall 13. The opening 18 size should permit crankshaft 24 to freely turn.

The position indicator 22, attached to the free end of crank arm 21, may be varied is size and material as desired bearing in mind that the indicator 22 is part of the counter weight which moves the assembly to the no mail or lowered position when the door 11 is opened. By providing additional, but optional, thickness to the indicator 22 three dimensional indication (front, side and back) is achieved. The indicator 22 may be a slice of wood rod and screwed to the free end of exterior crank arm 21. Alternatively the indicator 22 may be in the form of a traditional flag and welded to otherwise fastened to crank arm 22 and the flag may be flat or bent across the flag (e.g. right angle bend) to achieve a third dimension signal effect as shown in FIG. 1.

The location of the crankshaft 23 in side wall 13 is a matter of choice so long as interior crank arm 24 is in operative location with the door 11.

The angle or degree of the offset or opposed location of crank arms 21, 24 may be varied as desired. However, for the smaller mail boxes, it has been found desirable to have the crank arms 21, 24 form less than a 180° angle with respect to each other. For the small boxes an offset angle of 135° is very satisfactory.

The foregoing examples and methods have been described in the foregoing specification for the purpose of illustration and not limitation. Many modifications and ramifications will naturally suggest themselves to those skilled in the art based on this disclosure. These are intended to be comprehended as within the scope of this invention.

The embodiments of the invention in which an exclusive property or privilege is claimed are defined as follows:

1. In a mail box or similar container which is opened at one end, said box having a door hinged along one edge of said open end for closing said opening, the improvement comprising a self canceling signal positioned on a side wall of said mail box near said open end, said signal having a crankshaft which extends through an opening in said side wall to the exterior of and to the interior of said mail box and to each end of the crankshaft is a crank arm, each arm being perpendicular to said crankshaft and in an offset direction to the other crank arm, said crank arm on the interior of said box extending from said crankshaft through the plane of said door when in the closed position, said arm on the exterior of said box having at it's end opposite said crankshaft a combination weight and position indicator.

2. The mail box of claim 1 wherein said hinge is in a plane that is substantially perpendicular to the plane of the portion of the side wall containing said signal.

3. The mail box of clam 1 wherein said exterior crank arm is substantially equal in length to the length of said interior crank arm.

4. The mail box of claim 1 wherein said exterior arm is substantially longer in length than the length of said interior crank arm.

5. The mail box of claim 1 wherein the crankshaft is additionally supported by means affixed to said side wall of the mail box.

6. The mail box of claim 1 wherein said interior crank arm has a downward bend and terminates in a rounded surface.

7. The mail box of claim 1 wherein said crank arms are so positioned as to form an angle of about 135°.

8. The mail box of claim 1 wherein said position indicator is readily visibly in two directions.

* * * * *